US010321530B2

(12) United States Patent
Qiu

(10) Patent No.: US 10,321,530 B2
(45) Date of Patent: Jun. 11, 2019

(54) GRAVITY SENSING FLASHLIGHT AND ITS ELECTRIC CONTROL CIRCUIT

(71) Applicant: NINGBO FUTAI ELECTRIC LIMITED, Ningbo, Zhejiang Province (CN)

(72) Inventor: Fujun Qiu, Ningbo (CN)

(73) Assignee: NINGBO FUTAI ELECTRIC LIMITED, Ningbo (CN)

( * ) Notice: Subject to any disclaimer, the term of this patent is extended or adjusted under 35 U.S.C. 154(b) by 213 days.

(21) Appl. No.: 14/896,968

(22) PCT Filed: Mar. 27, 2015

(86) PCT No.: PCT/CN2015/075182
§ 371 (c)(1),
(2) Date: Dec. 9, 2015

(87) PCT Pub. No.: WO2016/138682
PCT Pub. Date: Sep. 9, 2016

(65) Prior Publication Data

US 2016/0381755 A1 Dec. 29, 2016

(30) Foreign Application Priority Data

Mar. 5, 2015 (CN) ..... 2015 1 0097166

(51) Int. Cl.
*F21L 4/00* (2006.01)
*F21V 23/04* (2006.01)
(Continued)

(52) U.S. Cl.
CPC ..... *H05B 33/0848* (2013.01); *F21L 4/00* (2013.01); *F21L 4/027* (2013.01);
(Continued)

(58) Field of Classification Search
CPC .. F21V 23/0442; F21V 23/0414; F21L 4/027; F21L 4/00
(Continued)

(56) References Cited

U.S. PATENT DOCUMENTS 8,425,078 B2 * 4/2013 Matthews ..... F21L 4/005 362/205
2003/0057889 A1 * 3/2003 Avis ..... F21L 4/005 315/291
(Continued)

FOREIGN PATENT DOCUMENTS

CN 101725836 A 6/2010
CN 202266836 U 6/2011
(Continued)

*Primary Examiner* — Jong-Suk (James) Lee
*Assistant Examiner* — Eric T Eide
(74) *Attorney, Agent, or Firm* — Jiwen Chen

(57) ABSTRACT

The present invention discloses a gravity sensing flashlight, including a lamp holder, a cylindrical body and a tail cover, the lamp holder and tail cover being connected to the cylindrical body, a storage battery being provided in the cylindrical body, a switch being mounted on a side wall of the cylindrical body, a circuit board being mounted in the switch, a gravity sensor and an indicator light being provided on the circuit board; the lamp holder includes a shell cap, a shell body and a shell base which are in threaded connection to each other, a lens, a lens holder, an LED lamp bead and a lamp bead fixing frame being mounted in the shell body, a current chip controller being mounted on the lamp bead fixing frame, the current chip controller being connected to the LED lamp bead and the gravity sensor.

3 Claims, 6 Drawing Sheets

(51) Int. Cl.
*H05B 33/08* (2006.01)
*F21L 4/02* (2006.01)
*F21Y 115/10* (2016.01)

(52) U.S. Cl.
CPC ..... *F21V 23/0414* (2013.01); *F21V 23/0442* (2013.01); *F21Y 2115/10* (2016.08)

(58) Field of Classification Search
USPC ..... 362/302, 208
See application file for complete search history.

(56) References Cited

U.S. PATENT DOCUMENTS

2006/0039139 A1* 2/2006 Maglica ..... F21L 4/027 362/202
2008/0013305 A1* 1/2008 Kang ..... F21L 4/085 362/157
2008/0272928 A1 11/2008 Shuster
2009/0290333 A1* 11/2009 Sharrah ..... H01H 9/06 362/183
2010/0033963 A1* 2/2010 Maglica ..... F21L 4/005 362/208
2010/0219775 A1* 9/2010 Maglica ..... F21L 4/045 315/362
2013/0182419 A1* 7/2013 Worman ..... F21V 15/01 362/183
2014/0140048 A1* 5/2014 Miller ..... H02J 7/0027 362/183
2015/0233563 A1* 8/2015 Henskes ..... F21V 23/0492 362/362

FOREIGN PATENT DOCUMENTS

CN 202032522 U 11/2011
CN 203810084 U 9/2014
CN 203814025 U 9/2014
JP 2002203401 A 7/2002

* cited by examiner

GRAVITY SENSING FLASHLIGHT AND ITS ELECTRIC CONTROL CIRCUIT

This is a U.S. national stage application of PCT Application No. PCT/CN2015/075182 under 35 U.S.C. 371, filed Mar. 27, 2015 in Chinese, claiming the priority benefit of Chinese Application No. 201510097166.4, filed Mar. 5, 2015, which is hereby incorporated by reference.

TECHNICAL FIELD

The present invention relates to the lighting field, in particular to a gravity sensing flashlight and its electric control circuit.

BACKGROUND OF THE PRESENT INVENTION

Through researches on people's daily action habits of using a flashlight, it has been found that people's hands holding the flashlight will generate a downward action when the flashlight is used to illuminate a near distance, because quite bright light is not required at this time; however, people's hands holding the flashlight will generate an upward action when the flashlight is used to illuminate a far distance, so that it is indicated that highest brightness is required at this time. As the brightness of an prior art flashlight is fixed or its brightness adjustment will not be automatically changed according to environmental needs, the relay ability of the flashlight is low and the service life is even reduced due to the use in high brightness.

SUMMARY OF THE PRESENT INVENTION

The object of the present invention is to solve the deficiencies of the prior art and provide a gravity sensing flashlight and an electric control circuit, with brightness adjustment being automatically changed according to environmental needs.

To achieve the above object, the present invention designs a gravity sensing flashlight, including a lamp holder, a cylindrical body and a tail cover, the lamp holder being connected to a head end of the cylindrical body, the tail cover being connected to a tail end of the cylindrical body, a storage battery as a power supply being internally provided in the cylindrical body, a switch being additionally mounted on a side wall of the cylindrical body, wherein the switch consists of a switch leather sheath, a knockout rod, a knockout rod fixing frame and a circuit board fixing frame in turn from inside to outside, a circuit board being mounted on the circuit board fixing frame, a gravity sensor, a switch button and an indicator light being provided on the circuit board; and, the lamp holder consists of a shell cap, a shell body and a shell base which are in threaded connection to each other, a lens, a lens holder, an LED lamp bead and a lamp bead fixing frame being mounted in the shell body, a current chip controller being mounted on the lamp bead fixing frame, one end of the current chip controller being connected to the LED lamp bead while the other end thereof being connected to the gravity sensor.

The switch not only may turn on or off the power supply, but also may switch the operating mode of the flashlight. When the flashlight is at a normal mode, three different modes, i.e., a high mode, a low mode and a flashing mode, may be controlled by the switch. Here, the three modes are switched by the knockout rod in the switch. When the flashlight is switched to an automatic mode, the flashlight may automatically judge and adjust brightness according to the change in action of a user in using the flashlight at a far/near distance, thereby realizing the effects of saving energy and prolonging the service life of a battery. In the actual use of the product, during a switchover between far distance illumination and near distance illumination, by virtue of the change of this action, a gravity sensor sends a signal to the current chip controller to adjust the current, thereby achieving the purpose of automatically adjusting brightness, greatly saving the electric quantity of the battery and prolonging the service life of the battery.

To fix an LED lamp bead in the cylindrical body of the flashlight more steadily, a mounting bracket consisting of more than three arc surfaces is provided on the shell base of the lamp holder, with an adjusting base being sheathed outside the mounting bracket, a rotating base being inserted inside the mounting bracket, a lug being provided on the rotating base, the width of the lug being the same as the width of a gap between the arc surfaces. The specific installation is as follows: the lug on the rotating base is firstly clamped on the mounting bracket of the shell base through the gap between the arc surfaces, then the LED lamp bead and the lamp bead fixing frame are together fixed on the rotating base, and the adjusting base is sheathed outside the mounting bracket, so that the whole internal structure becomes steady. Meanwhile, a conical surface fitted with the lamp bead fixing frame in the shell body is provided at an upper end of the rotating base. To be convenient to mount the adjusting base on the mounting bracket, the outer side of the adjusting base is in a hexagon or an octagon shape.

For mounting convenience, the tail cover is in detachable connection to the cylindrical body; meanwhile, to improve the air-tightness between the tail cover and the cylindrical body, a sealing ring is provided between the tail cover and the cylindrical body. An electric control circuit for the gravity sensing flashlight is provided, comprising a power supply circuit, a current chip circuit, a gravity sensing circuit and an LED lamp bead circuit, wherein the current chip circuit is in signal connected to the gravity sensing circuit through a switch; the power supply circuit comprises a power supply chip; the current chip circuit comprises a current chip; the gravity sensing circuit comprises a gravity sensing chip; and, the LED lamp bead circuit comprises an LED lamp, a field effect transistor and a first resistor.

In the gravity sensing flashlight provided by the present invention, the switch not only may turn on or off the power supply, but also may switch the operating mode of the flashlight. When the flashlight is at a normal mode, three different modes, i.e., a high mode, a low mode and a flashing mode, may be controlled by the switch. Here, the three modes are switched by the knockout rod in the switch. When the flashlight is switched to an automatic mode, the flashlight may automatically judge and adjust brightness according to the change in action of a user in using the flashlight at a far/near distance, thereby realizing the effects of saving energy and prolonging the service life of a battery. In the actual use of the product, during a switchover between far distance illumination and near distance illumination, by virtue of the change of this action, a gravity sensor sends a signal to the current chip controller to adjust the current, thereby achieving the purpose of automatically adjusting brightness, greatly saving the electric quantity of the battery and prolonging the service life of the battery. Meanwhile, the internal structures of the gravity sensing flashlight are fixed layer by layer, so the LED lamp bead may be stably disposed in the flashlight.

in which:

1: Lamp holder;
2: Cylindrical body;
3: Tail cover;
4: Switch;
5: Arc surfaces;
6: Mounting bracket;
7: Adjusting base;
8: Rotating base;
9: Lug;
10: Sealing ring;
11: Shell cap;
12: Shell body;
13: Shell base;
14: Lens;
15: Lens holder;
16: LED lamp bead;
17: Lamp bead fixing frame;
18: Current chip controller;
41: Switch leather sheath;
42: Knockout rod;
43: Knockout rod fixing frame;
44: Circuit board fixing frame;
45: Circuit board;
46: Gravity sensor;
47: Switch button;
48: Indicator light;
51: Power supply circuit;
52: Current chip circuit;
53: Gravity sensing circuit;
54: LED lamp bead circuit;
U1: Current chip;
U2: Gravity sensing chip;
U3: Power supply chip;
L1: LED lamp;
Q1: Field effect transistor; and
R1: First resistor.

DETAILED DESCRIPTION OF THE PRESENT INVENTION

The present invention will be further described as below with reference to the drawings by embodiments.

Embodiment 1

Figure 1:
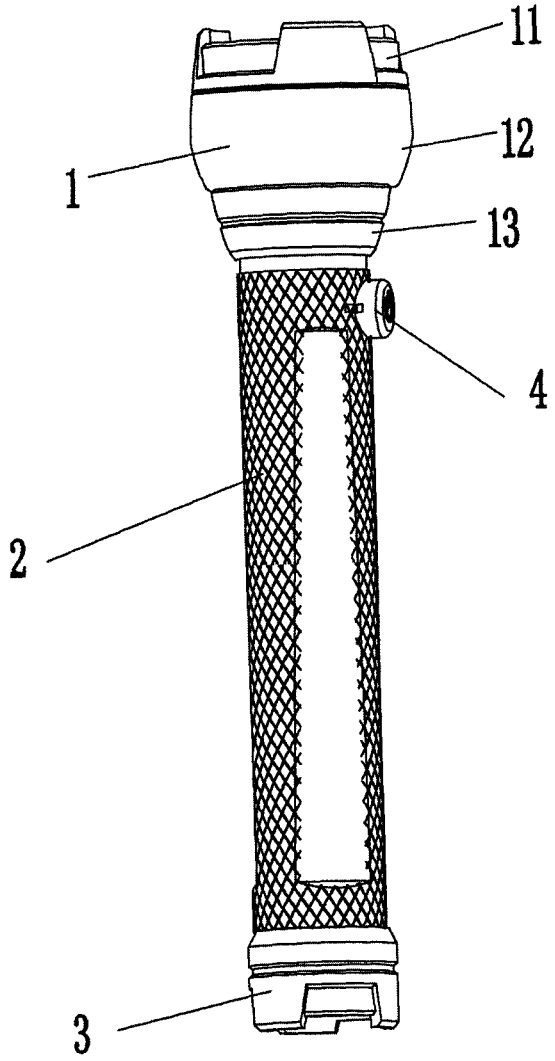
FIG. 1 is a structure diagram of a gravity sensing flashlight according to Embodiment 1.
Figure 2:
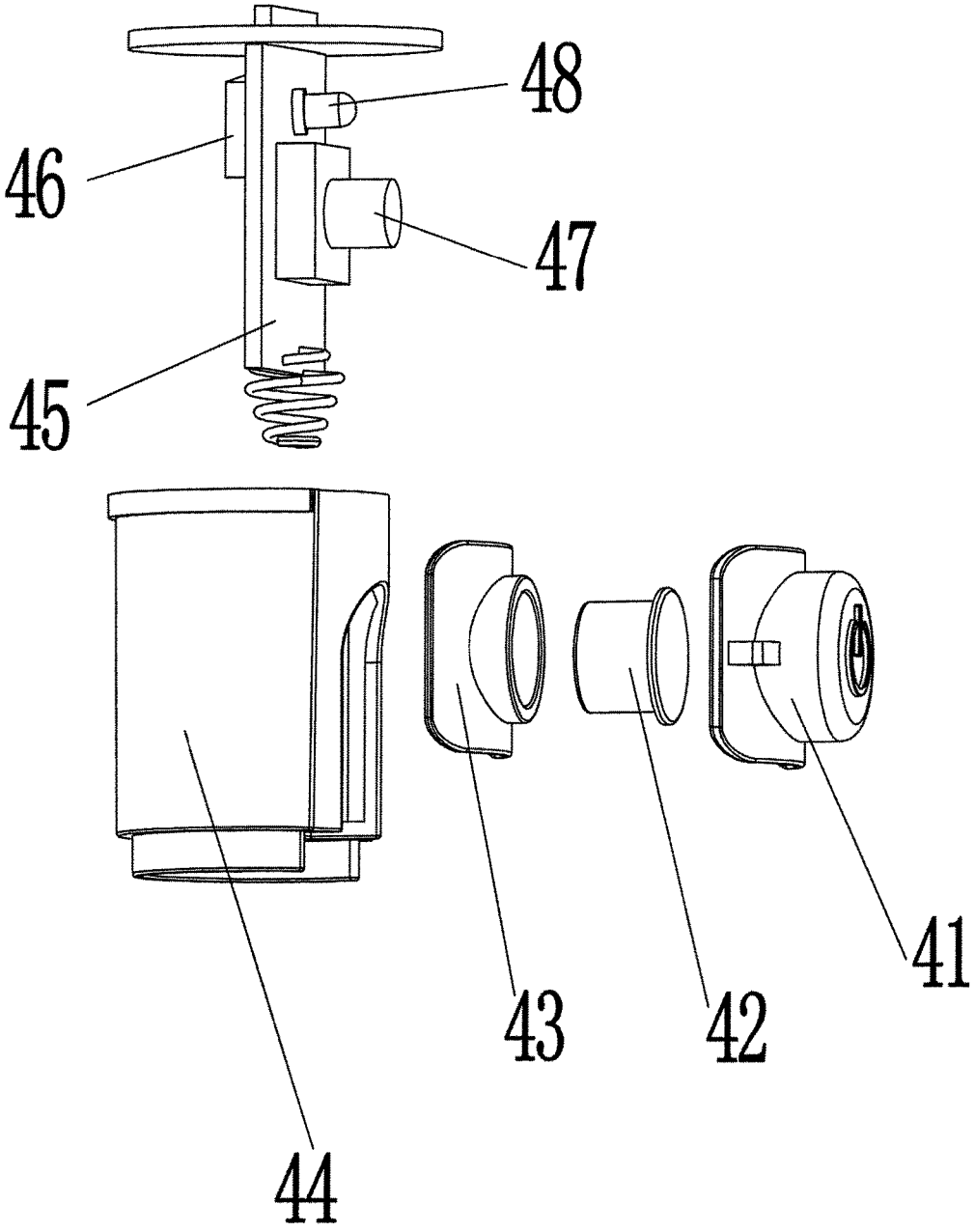
FIG. 2 is an exploded view of a switch in the gravity sensing flashlight according to Embodiment 1.
Figure 3:
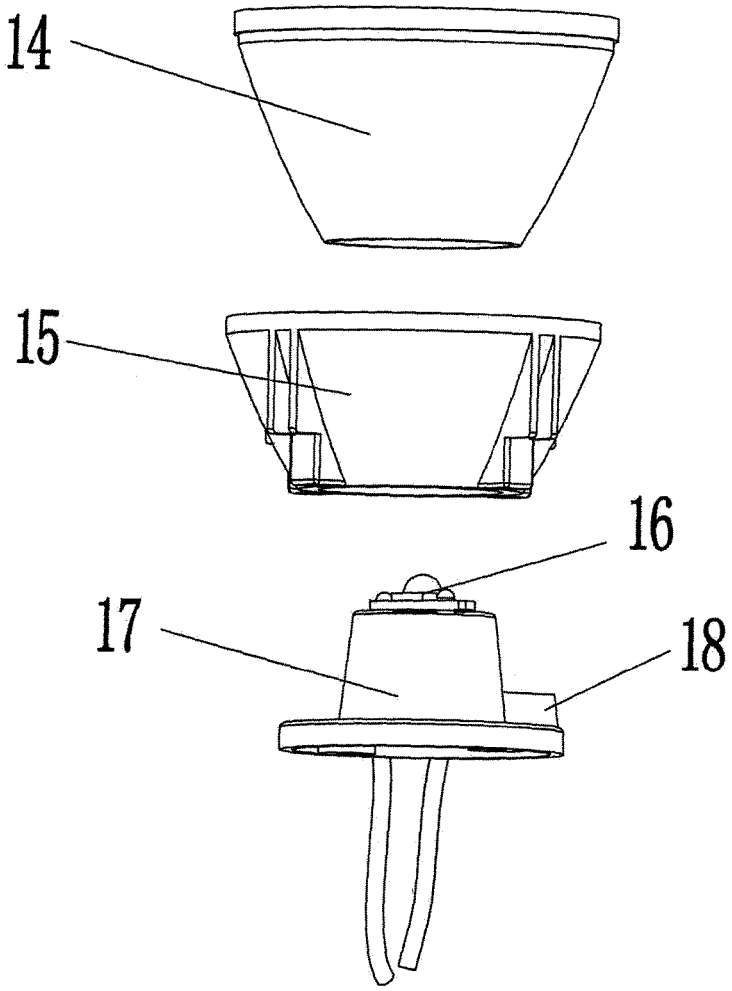
FIG. 3 is an internal exploded view of a lamp holder in the gravity sensing flashlight according to Embodiment 1.

As shown in FIG. 1, FIG. 2 and FIG. 3, this embodiment provides a gravity sensing flashlight, comprising a lamp holder 1, a cylindrical body 2 and a tail cover 3, the lamp holder 1 being connected to a head end of the cylindrical body 2, the tail cover 3 being connected to a tail end of the cylindrical body 2, a storage battery as a power supply being internally provided in the cylindrical body 2, a switch 4 being additionally mounted on a side wall of the cylindrical body 2, wherein the switch 4 consists of a switch leather sheath 41, a knockout rod 42, a knockout rod fixing frame 43 and a circuit board fixing frame 44 in turn from inside to outside, with a circuit board 45 being mounted on the circuit board fixing frame 44, and a gravity sensor 46, a switch button 47 and an indicator light 48 being provided on the circuit board 45; and, the lamp holder 1 consists of a shell cap 11, a shell body 12 and a shell base 13 which are in threaded connection to each other, with a lens 14, a lens holder 15, an LED lamp bead 16 and a lamp bead fixing frame 17 being mounted in the shell body 12, a current chip controller being mounted on the lamp bead fixing frame 17, one end of the current chip controller 18 being connected to the LED lamp bead 16 while the other end thereof being connected to the gravity sensor 46.

Figure 4:
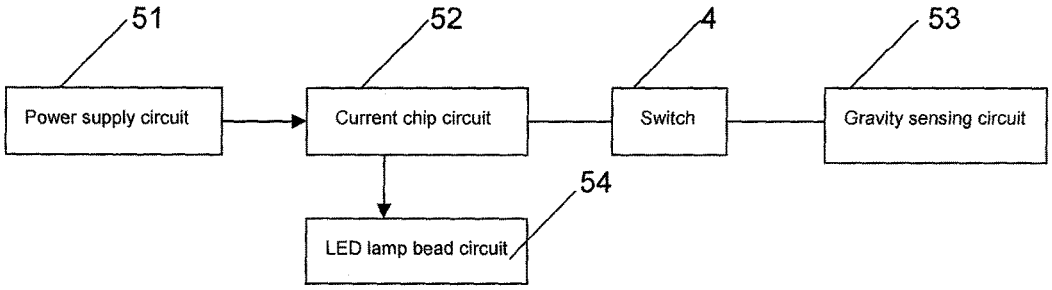
FIG. 4 is a flow chart of a control circuit of the gravity sensing flashlight according to Embodiment 1.
Figure 5:
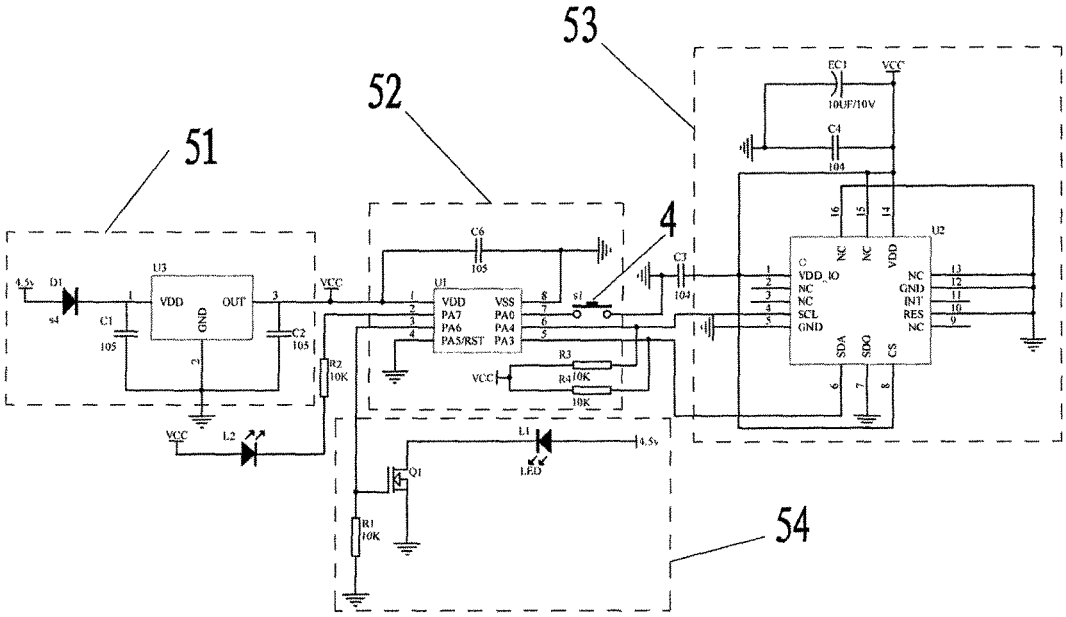
FIG. 5 is a schematic diagram of the control circuit of the gravity sensing flashlight according to Embodiment 1.

As shown in FIG. 4 and FIG. 5, a control circuit for the gravity sensing flashlight is provided, comprising a power supply circuit 51, a current chip circuit 52, a gravity sensing circuit 53 and an LED lamp bead circuit 54 which are connected in turn, wherein the current chip circuit 52 is in signal connected to the gravity sensing circuit 53 through a switch 4; the power supply circuit 51 comprises a power supply chip U3; the current chip circuit 52 comprises a current chip U1; the gravity sensing circuit 53 comprises a gravity sensing chip U2; and, the LED lamp bead circuit 54 comprises an LED lamp L1, a field effect transistor Q1 and a first resistor R1.

In the gravity sensing flashlight provided by the present invention, the switch not only may turn on or off the power supply, but also may switch the operating mode of the flashlight. When the flashlight is at a normal mode, three different modes, i.e., a high mode, a low mode and a flashing mode, may be controlled by the switch 4. Here, the three modes are switched by the knockout rod 42 in the switch 4. When the flashlight is switched to an automatic mode, the flashlight may automatically judge and adjust brightness according to the change in action of a user in using the flashlight at a far/near distance, thereby achieving the effects of saving energy and prolonging the service life of a battery. In the actual use of the product, during a switchover between far distance illumination and near distance illumination, by virtue of the change of this action, the gravity sensor 46 sends a signal to the current chip controller 18 to adjust the current, thereby achieving the purpose of automatically adjusting brightness, greatly saving the electric quantity of the battery and prolonging the service life of the battery.

Embodiment 2

Figure 6:
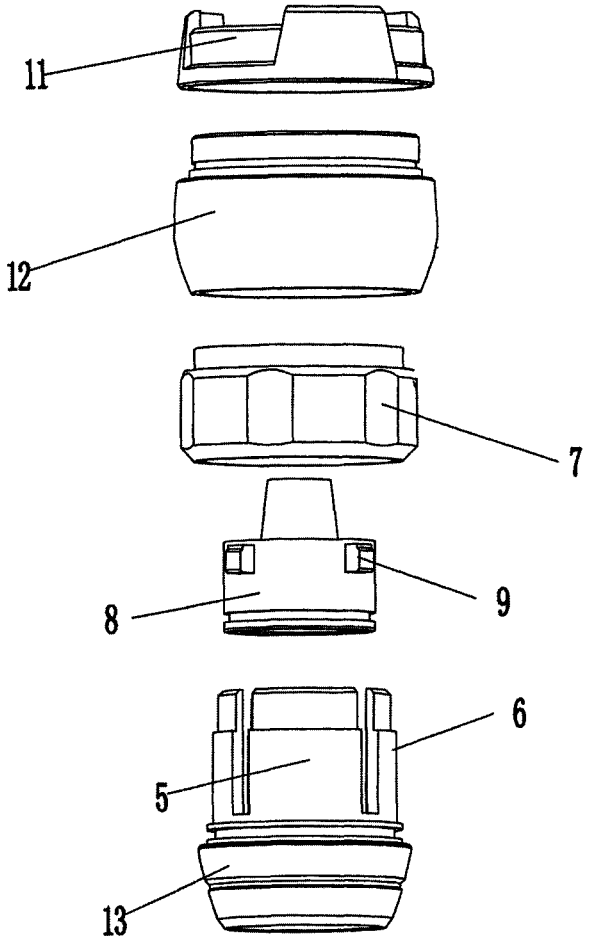
FIG. 6 is an exploded view of a lamp holder in a gravity sensing flashlight according to Embodiment 2.

As shown in FIG. 6, this embodiment provides a gravity sensing flashlight and a control circuit. The general structure is the same as Embodiment 1, but when in specific use, to fix an LED lamp bead in the cylindrical body of the flashlight more steadily, a mounting bracket 6 consisting of more than three arc surfaces 5 is provided on the shell base 13 of the lamp holder 1. An adjusting base 7 is sheathed outside the mounting bracket 6, and a rotating base 8 inserted inside the mounting bracket 6. A lug 9 is provided on the rotating base 8, with the width of the lug 9 being the same as the width of a gap between the arc surfaces 5. A conical surface which may be fitted with the lamp bead fixing frame 17 in the shell body 12 is provided at an upper end of the rotating base 8. The outer side of the adjusting base 7 is a hexagon or an octagon. The specific installation is as follows: the lug 9 on the rotating base 8 is first clamped on the mounting bracket 6 of the shell base through the gap between the arc surfaces 5, then the LED lamp bead 16 and the lamp bead fixing frame 17 are together fixed on the rotating base 8, and the adjusting base 7 is sheathed outside the mounting bracket 6, so that the whole internal structure becomes steady. The internal structures of the gravity sensing flashlight are fixed layer by layer, so the LED lamp bead 16 may be stably disposed in the flashlight.

Embodiment 3

Figure 7:
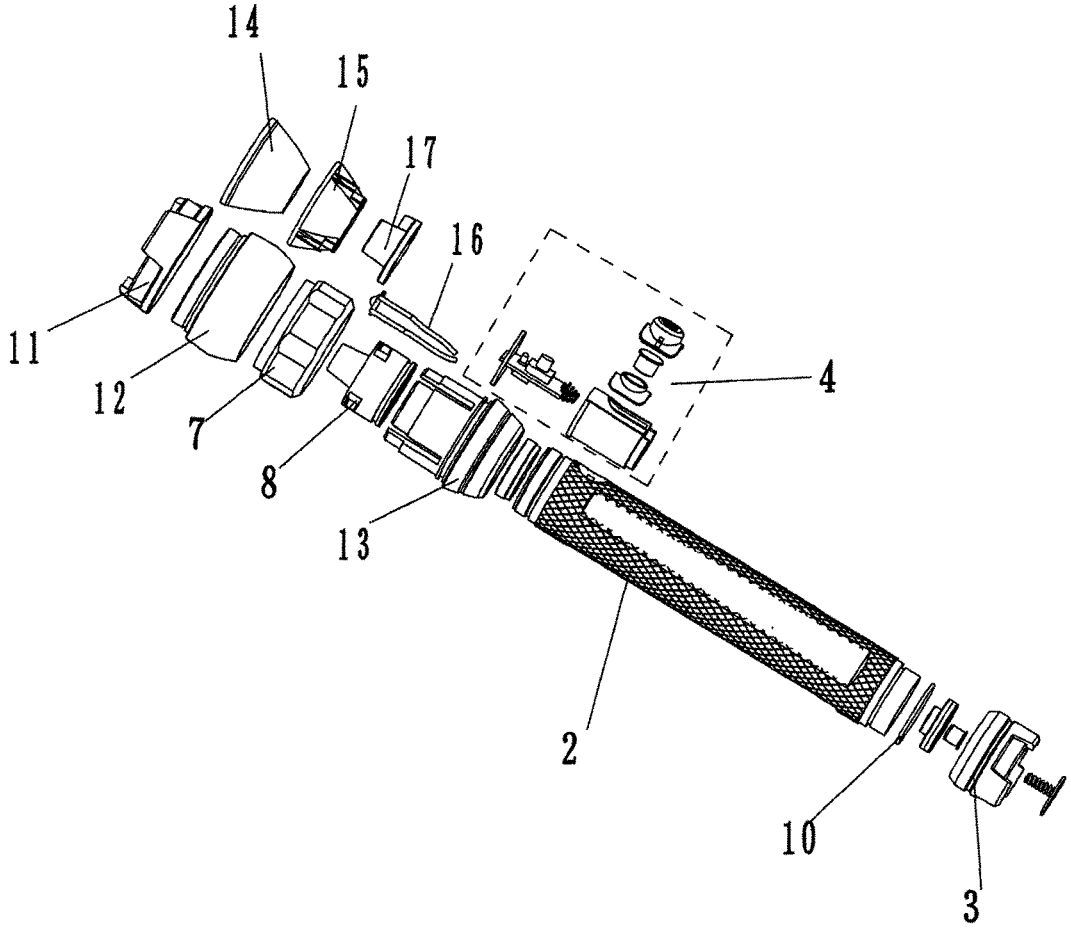
FIG. 7 is an overall exploded view of the gravity sensing flashlight according to Embodiment 2.

As shown in FIG. 7, this embodiment provides a gravity sensing flashlight and a control circuit. The general structure is the same as Embodiment 2, but when in specific use, for mounting convenience, the tail cover 3 is in detachable connection to the cylindrical body 2; meanwhile, to improve the air-tightness between the tail cover 3 and the cylindrical body 2, a sealing ring 10 is provided between the tail cover 3 and the cylindrical body 2.

The invention claimed is:

1. A gravity sensing flashlight, comprising a lamp holder, a cylindrical body and a tail cover, the lamp holder being connected to a head end of the cylindrical body, the tail cover being connected to a tail end of the cylindrical body, a storage battery as a power supply being internally provided in the cylindrical body, a switch being additionally mounted on a side wall of the cylindrical body, characterized in that the switch consists of a switch leather sheath, a knockout rod, a knockout rod fixing frame and a circuit board fixing frame in turn from inside to outside, a circuit board being mounted on the circuit board fixing frame, a gravity sensor, a switch button and an indicator light being provided on the circuit board; and, the lamp holder consists of a shell cap, a shell body and a shell base which are in threaded connection to each other, a lens, a lens holder, an LED lamp bead and a lamp bead fixing frame being mounted in the shell body, a current chip controller being mounted on the lamp bead fixing frame, one end of the current chip controller being connected to the LED lamp bead while the other end thereof being connected to the gravity sensor;

wherein the shell base of the lamp holder is provided thereon with a mounting bracket consisting of more than three arc surfaces, an adjusting base being sheathed outside the mounting bracket, a rotating base being inserted inside the mounting bracket, a lug being provided on the rotating base, the width of the lug being the same as the width of a gap between the arc surfaces wherein a conical surface fitted with the lamp bead fixing frame in the shell body is provided at an upper end of the rotating base;

wherein the gravity sensing flashlight further comprises a control circuit, the control circuit comprising a power supply circuit, a current chip circuit, a gravity sensing circuit and an LED lamp bead circuit which are connected in turn, characterized in that the current chip circuit is in signal connected to the gravity sensing circuit through a switch; the power supply circuit comprises a power supply chip; the current chip circuit comprises a current chip; the gravity sensing circuit comprises a gravity sensing chip; and, the LED lamp bead circuit comprises an LED lamp, a field effect transistor and a first resistor; and wherein the switch and the control circuit are arranged to enable the flashlight to:

operate at a normal mode where a first brightness mode, a second brightness mode and a flashing mode can be selected, the first brightness mode being brighter than the second brightness mode; and operate at an automatic mode, where the flashlight automatically judges and adjusts brightness according to change in action of a user in using the flashlight to illuminate different distances so that an upward movement of the headend relative to the tail end results in higher brightness than a downward movement of the headend relative to the tail end.

2. The gravity sensing flashlight according to claim 1, characterized in that an outer side of the adjusting base is in a hexagon or an octagon shape.

3. The gravity sensing flashlight according to claim 1, characterized in that the tail cover is in detachable connection to the cylindrical body, and a sealing ring is provided between the tail cover and the cylindrical body.

* * * * *